United States Patent [19]

McCord

[11] 3,985,344

[45] Oct. 12, 1976

[54] ULTRASONIC CLEANING APPARATUS

[76] Inventor: James W. McCord, 9829 Timberwood Circle, Louisville, Ky. 40214

[22] Filed: June 2, 1975

[21] Appl. No.: 582,614

[52] U.S. Cl. ..... 259/1 R; 259/75; 259/77; 259/DIG. 44

[51] Int. Cl.[2] ..... B08B 3/12

[58] Field of Search ..... 259/1, 72, DIG. 44, 259/99, 114, 75, 77, 83

[56] References Cited

UNITED STATES PATENTS 3,582,733 6/1971 Brubaker ..... 259/1

3,638,666 2/1972 Fishman ..... 259/1

*Primary Examiner*—Richard E. Aegerter
*Assistant Examiner*—Willis Little

[57] ABSTRACT

An ultrasonic cleaning apparatus including a tank for holding a cleaning solvent therein and vibrating member having at least three sides disposed within the tank wherein each of the three sides is provided with at least one transducer attached thereto in order to provide ultrasonic vibrations within the walls of the three-sided vibrating member. Films, wires, and the like are cleaned by exposing the films, wires and the like to a liquid medium contained within this device utilizing cavitation to clean.

7 Claims, 4 Drawing Figures

ULTRASONIC CLEANING APPARATUS

BACKGROUND OF THE INVENTION

This invention relates to ultrasonic cleaning apparatuses and more particularly to an ultrasonic cleaning apparatus having a new, useful, and unobvious vibrating member disposed within a cleaning tank for cleaning strips of film, wire and the like.

In recent years there has been considerable activity in the use of ultrasonic generators and transducers for producing ultrasonic vibrations causing cavitation to exist in a fluid for cleaning of objects containing soils or other types of undesirable substances thereon. The energy produced by the ultrasonic generator in combination with a transducer generally at frequencies above 16,000 cycles per second (16 KHZ) when transmitted through a liquid and the vibrations generated thereby provided the energy for cleaning foreign particles from many types of objects such as surgical instruments, clothing, electronic panelboards and the like. The ultrasonic vibrations in the liquid induces rapid expansion and contraction of millions of microscopic bubbles, the implosion or collapse of these bubbles during the pressure reduction part of the cycle resulting in a powerful scrubbing action which pulls contaminants free from the parts immersed in the cleaning solution. The ultrasonic vibrations are usually transmitted to the cleaning fluid by mounting ultrasonic transducers on the exterior surface of one of the walls of the tank containing the cleaning solution or by mounting within the cleaning tank the transducers, the transducers being properly protected from the chemical action of the cleaning fluid. However, in the cleaning of long thin strips of wire, film, or other materials, a continuous process or apparatus which provides for quick release of these foreign particles has not been found.

SUMMARY OF THE INVENTION

In the present invention, it is recognized that it is desirable to provide an ultrasonic cleaning device. It is further recognized that it is desirable to provide an ultrasonic cleaning device for continuous cleaning of strips of wire, film, and other types of material. Also, it is recognized that it is desirable to provide an ultrasonic cleaning device utilizing ultrasonic transducers disposed in a plurality of positions around the object to be cleaned wherein the ultrasonic vibrations are transmitted in a plurality of varying directions.

The present invention advantageously provides a straightforward arrangement for an ultrasonic cleaning apparatus for cleaning strips of different types of material using ultrasonic waves transmitted from several different locations within the cleaning apparatus.

Various other features of the present invention will become obvious to those skilled in the art upon reading the disclosure set forth hereinafter.

More particularly, the present invention provides an ultrasonic cleaning apparatus comprising: a tank open at the top; an ultrasonic transducer housing having a pair of opposed openings therein mounted in the tank; and, a vibrating member disposed within the housing, the vibrating member having at least three side walls with at least one ultrasonic transducer attached to the outer surface of each side wall, the vibrating member having opposed open ends, the open ends being in alignment with the opposed openings in the transducer housing, the spacing between the opposed openings defining a cleaning zone.

It is to be understood that the description of the examples of the present invention given hereinafter are not by way of limitation. Various modifications within the scope of the present invention will occur to those skilled in the art upon reading the disclosure set forth hereinafter.

Referring to the drawings.

Figure 1:
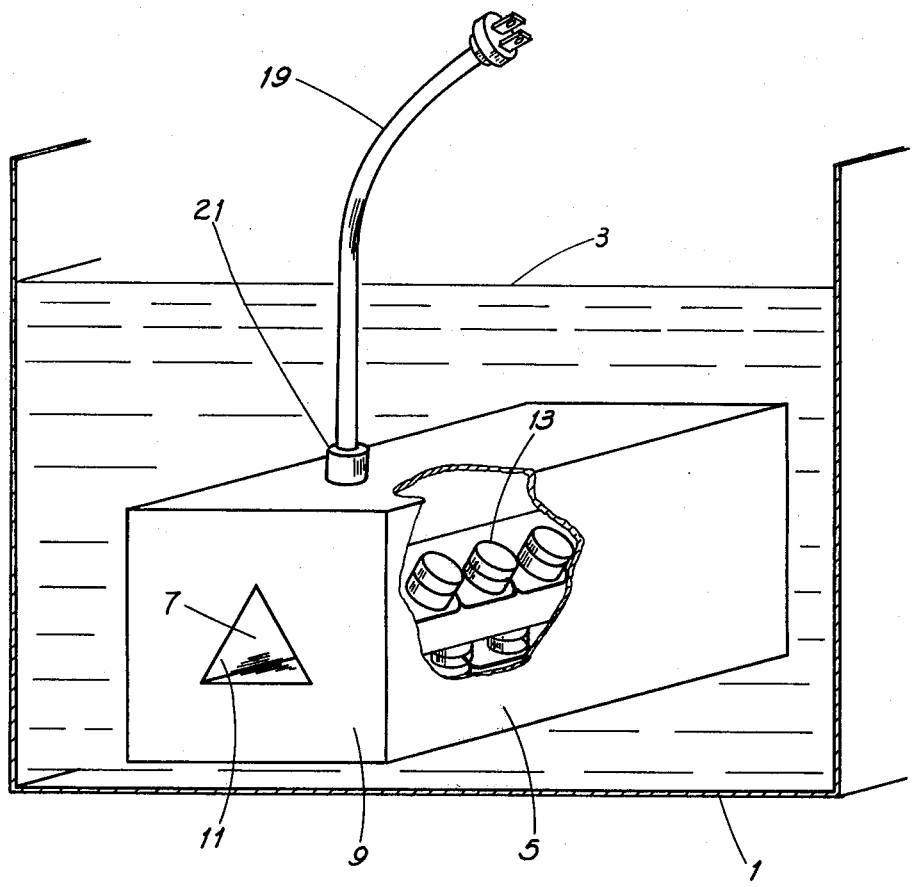
FIG. 1 is a perspective view, partially cutaway, of one ultrasonic cleaning apparatus of the present invention.

Referring now to the figures, in FIG. 1 in particular, there is shown a tank 1 with an open top which is adapted to be filled with a cleaning solution 3. Mounted to the bottom of the tank 1 is a transducer housing 5 having a pair of opposed openings 7 therein, only one being shown, the opposed openings 7 being disposed in end walls 9 of the housing 5. Disposed within the housing 5 and attached at each end to end walls 9 is a vibrating member 11 having a triangular-shaped cross section with openings in each end thereof, the openings being in fluid communication with the openings 7 in the housing 5. Vibrating member 11 having open ends therein is adapted to be immersed in and receive the cleaning solution, the spacing between the open ends defining a cleaning zone for cleaning strips of material.

The vibrating member 11 is usually made of stainless steel or other suitable materials not subject to corrosion by the cleaning solution.

Figure 2:
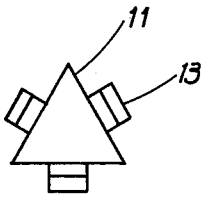
FIG. 2 is an end view of the vibrating member including the ultrasonic transducers of FIG. 1.

Attached to each of the side walls of the vibrating member 11 is at least one transducer 13, three transducers being shown in FIGS. 1 and 2 for each wall. The transducers 13 are located on the outer surfaces of the side walls and do not come in contact with the cleaning solution which is disposed within the cleaning zone defined above. Transducers 13, as illustrated here, are of the electrostrictive type but it is realized that other types of transducers, for instance magnitostrictive transducers, may also be employed without departing from the principals of the invention. The front face of the transducers 13 are attached to the vibrating member 11 by any known means.

As used in the present invention, the word transducer is meant to be a device to convert electrical energy to mechanical energy. In this case, the supplying of 25 KHZ electrical energy to a compression transducer utilizing lead zirconate titanate resonant material. One or more of these units are attached to a vibrating plate (diaphragm) which moves at approximately the same frequency. This vibration transmits pressure waves in a liquid medium causing cavitation. However, it is realized that the use of other frequencies or resonant type devices are within the scope and spirit of the present invention.

Disposed separately from tank 1 is an ultrasonic generator (not shown) which is a commercially used common emitter of converted frequency and receives its low voltage, low frequency input from an AC power line (not shown). It is understood that any other conversion circuit may be used which converts 60 cycle, or other line frequency electrical energy to high frequency energy suitable for operating the transducers 13, the energy being transmitted from the ultrasonic generator to the transducers 13 through electrical lines or cable 19.

Electrical cable 19 is usually contained in either rigid or flexible tubing, cable 19 being attached to the transducer by a compression fitting 21 welded to the transducer housing 5 and compressed on the tubing to provide a leak tight joint.

In the operation of the ultrasonic cleaning device of FIG. 1, the tank 1 including vibrating member 11 therein is filled with a suitable cleaning solvent 3 which is usually an organic solvent such as the chlorinated hydrocarbons, for example, trichloromonofluoromethane, trichlorotrifluoroethane, trichloroethylene, carbon tetrachloride, and the like. This system can also be used with water based materials. Ultrasonic vibrations are then started by energizing the ultrasonic generator 15, the ultrasonic vibrations, as shown in FIG. 1, being directed in three different directions thereby causing violent agitation within the cleaning zone of the vibrating member 11. A strip of material which is to be cleaned is then inserted into the tank 1 and into the cleaning zone of the vibrating member 11, the strip being inserted through one opening 7 and out the opening at the opposite end of the transducer housing 5. The strip of material, which may be wire, film, or other materials containing grease or other foreign particulates adhered thereto, is then continuously pulled through the cleaning zone wherein the strip of material is subjected to the violent vibrations or agitations set up by the opposed transducers 13.

It is also realized that the transducer housing 5 may be disposed in a vertical position as well as the horizontal position as shown in FIG. 1 without departing from the scope of the invention.

Figure 3:
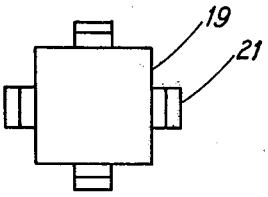
FIG. 3 is an end view of another preferred vibrating member including a plurality of ultrasonic transducers which may be utilized in the ultrasonic cleaning apparatus of FIG. 1; and, FIG. 4 is an end view of even another preferred vibrating member including a plurality of ultrasonic transducers which may be utilized in the ultrasonic cleaning apparatus of FIG. 1.
Figure 4:
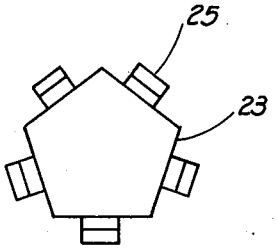

FIGS. 3 and 4 show other configurations of the vibrating members which may be utilized in the ultrasonic cleaning apparatus of the instant invention. In FIG. 3 the vibrating member is a four-sided member 19 having at least one transducer 21 mounted to each of the four sides. FIG. 4 shows a vibrating member 23 having five sides with at least one ultrasonic transducer 25 mounted to each of the sides. It is realized that other vibrating members having any number of sides may be utilized in the instant invention wherein at least one transducer is mounted to each of the side walls thereof.

It is to be understood that the forms of my invention hereindescribed and illustrated are only examples of the same and that various modifications in the shape, size, and arrangement of parts may be resorted to, without departing from the scope and spirit of my invention.

What is claimed is:

1. An ultrasonic cleaning apparatus comprising:

a. a tank open at the top;

b. an ultrasonic transducer housing having a pair of opposed openings therein mounted in said tank;

c. a vibrating member disposed within the housing, the vibrating member having at least three side walls;

d. at least one ultrasonic transducer attached to the outer surface of each side wall; and, e. said vibrating member having opposed open ends, said open ends being in alignment with the opposed openings in said transducer housing, the spacing between the opposed openings defining a cleaning zone.

2. The ultrasonic cleaning apparatus of claim 1 wherein said cleaning zone is disposed in a horizontal position.

3. The ultrasonic cleaning apparatus of claim 1 wherein said cleaning zone is disposed in a vertical position.

4. The ultrasonic cleaning apparatus of claim 1 wherein said vibrating member is fixedly attached to opposed ends of said transducer housing.

5. The ultrasonic cleaning apparatus of claim 1 wherein said ultrasonic transducer is of the electrostrictive type.

6. The ultrasonic cleaning apparatus of claim 1 wherein said ultrasonic transducer is of the magnetostrictive type.

7. The ultrasonic cleaning apparatus of claim 1 including electrical input lines to said transducer for electrical communication with an ultrasonic generator, the lines being contained in a tubing, the tubing being attached to said transducer housing by a compression fitting welded to said transducer housing and compressed on said tubing to provide a leak tight joint.

* * * * *